US005649663A

United States Patent [19]

Pestow, Jr.

[11] Patent Number: 5,649,663

[45] Date of Patent: Jul. 22, 1997

[54] PRODUCE CONTAINER IMPROVEMENT

[75] Inventor: Charles A. Pestow, Jr., McAllen, Tex.

[73] Assignee: Weyerhaeuser Company, Tacoma, Wash.

[21] Appl. No.: 656,139

[22] Filed: May 31, 1996

[51] Int. Cl.[6] ..... B65D 21/032

[52] U.S. Cl. ..... 229/190; 229/174; 229/915; 229/918

[58] Field of Search ..... 229/174, 178, 229/915, 918, 919, 190

[56] References Cited

U.S. PATENT DOCUMENTS

| | | | |
|---|---|---|---|
| 2,965,279 | 12/1960 | Campbell | 229/915 |
| 3,883,067 | 5/1975 | McGlynn et al. | 229/190 |
| 3,940,053 | 2/1976 | Putman et al. | 229/915 |
| 4,319,710 | 3/1982 | Osborne | 229/190 |
| 4,567,996 | 2/1986 | Muise | 229/919 |
| 5,002,224 | 3/1991 | Muise | 229/918 |
| 5,452,848 | 9/1995 | Mur Gimeno | 229/918 |
| 5,535,941 | 7/1996 | Garza | 229/918 |

*Primary Examiner*—Gary E. Elkins

[57] ABSTRACT

A signle peece paperboard container is formed from a flat blank and includes side walls, end walls and a bottom. The end walls include a four ply the plys. Additional strength can be provided with an inclined corner post and an additional reinforcing panel extending along the wall, both of which are panels extending outwardly from an end panel when in blank form.

1 Claim, 3 Drawing Sheets

Fig. 1
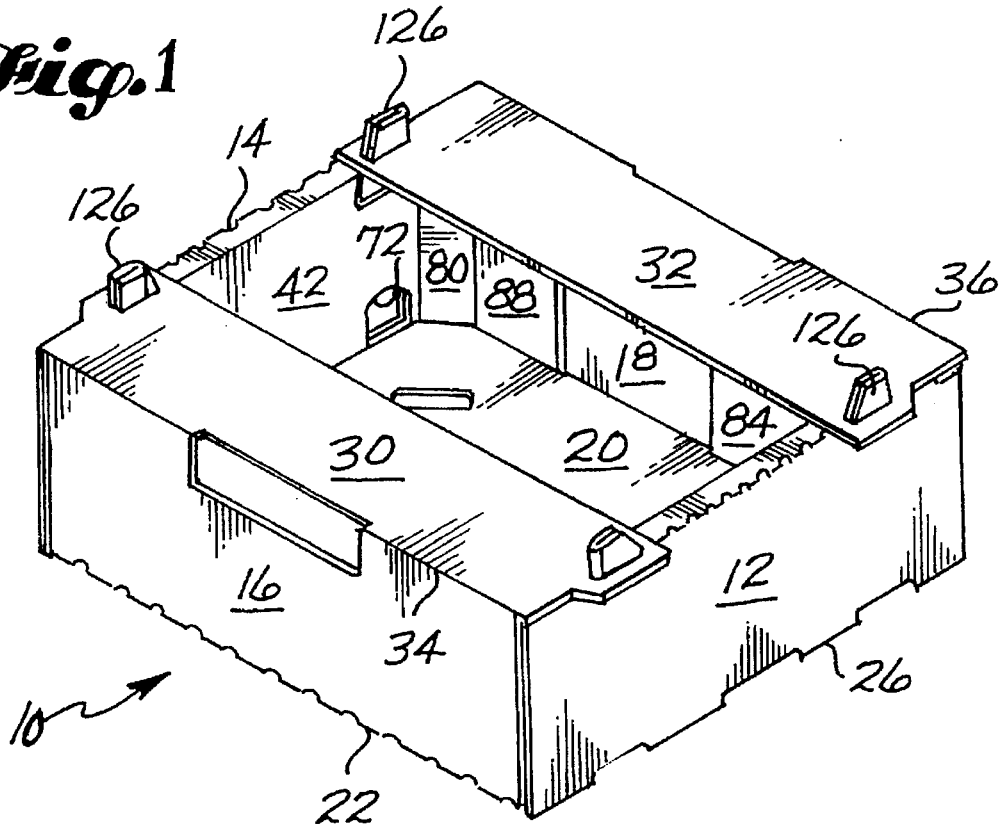
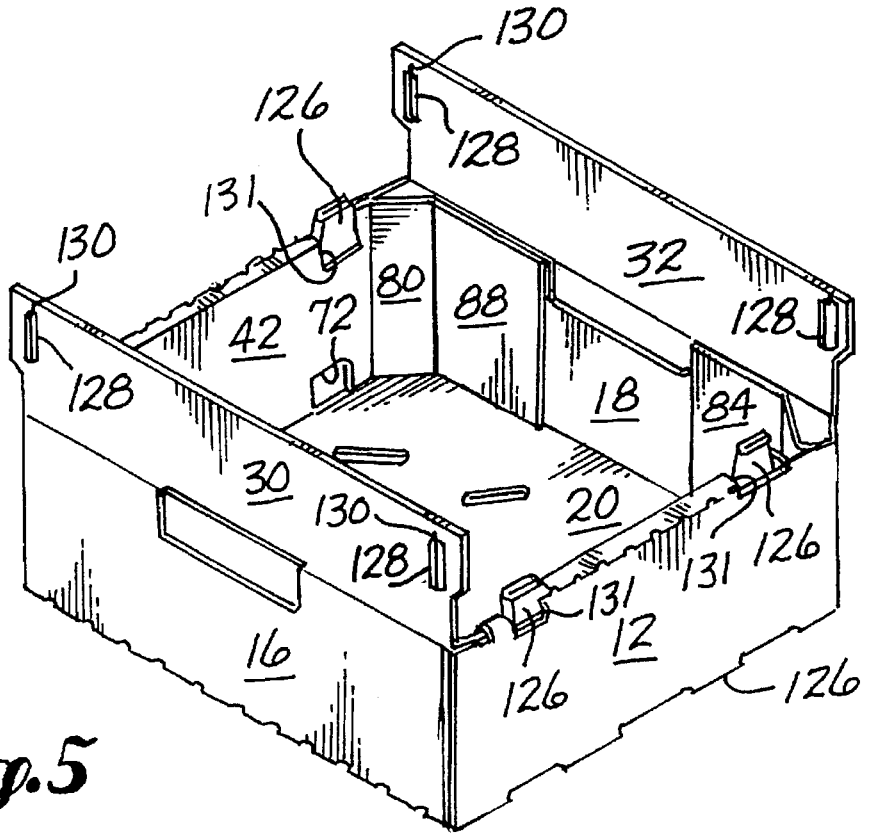
Fig. 5

Fig. 3
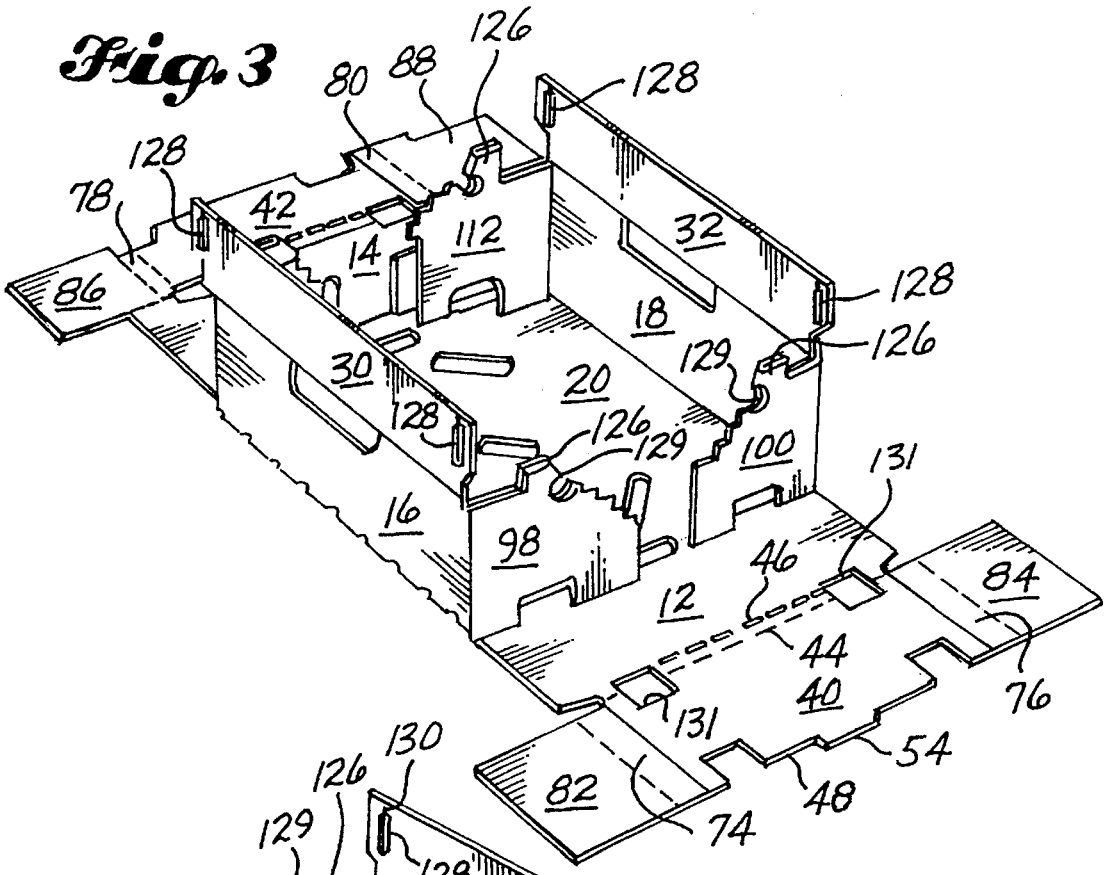
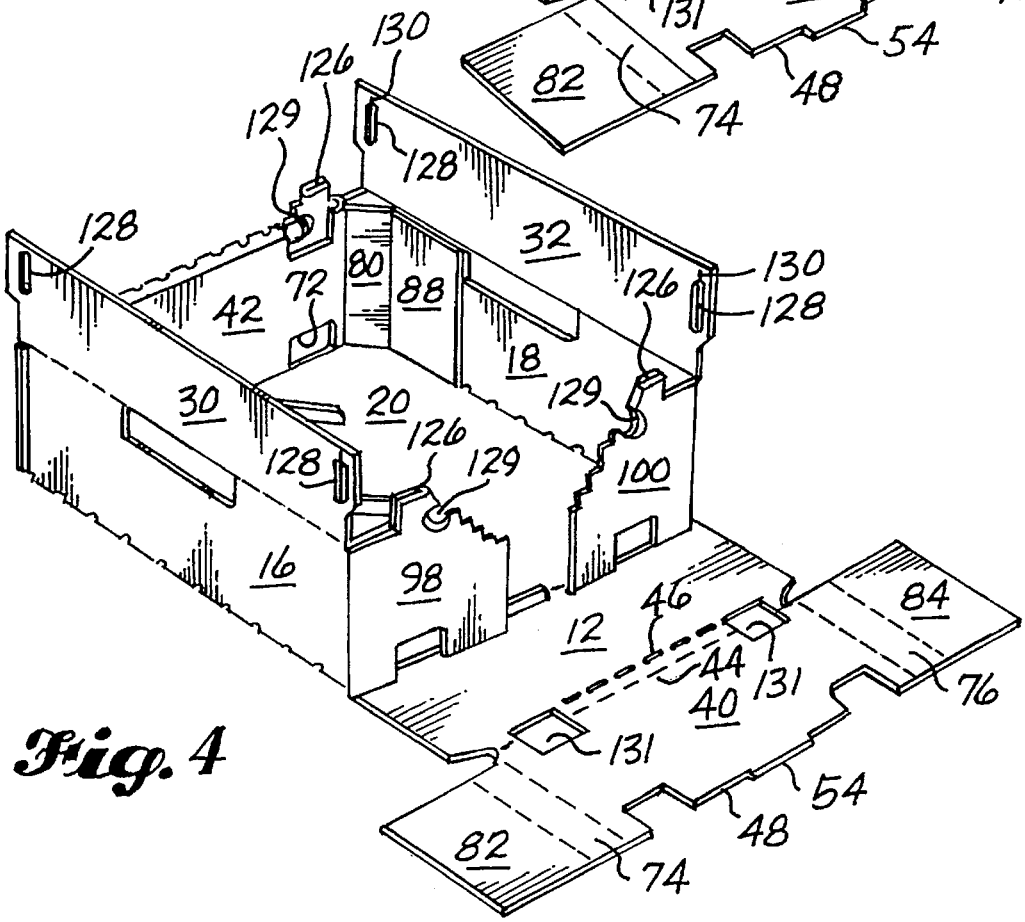
Fig. 4

PRODUCE CONTAINER IMPROVEMENT

BACKGROUND OF THE INVENTION

Flat sheets of corrugated paperboard have been used many years as the starting material in forming containers. Corrugated paperboard generally refers to a multilayer sheet material comprised of two sheets of liner bonded to a middle corrugated layer of medium. Usually, the corrugated container plant of today is located relatively close to its customer base and includes a corrugating and laminating machine to form the paperboard and thereafter, usually in-line, slitter-slotter-scoring machines and printing and packaging machines. The liner and medium paper rolls will normally come from paper mills which generally tend to be located close to their source for raw materials.

One style of container is the single-piece tray type where a single piece of corrugated paperboard will be cut and scored to form a flat blank which will then be erected into a container with four sides and a bottom. Oftentimes, closure flaps will be designed into the single-piece style. Some of these designs are provided with features to allow hand setup at a using facility while others are designed for machine setup where cooperating adjoining portions are adhesively bonded to form the container. Quite commonly, these types of containers are used for holding fresh fruits and produce from packing and shipping to display at the retail level.

Usually when packing a particular product such as tomatoes, peaches, mangos and the like there is a typical size requirement in that the container volume is sized to hold a certain amount of product. There is also a strength requirement given the weight of product packed and the stacking, shipping and handling requirements. Of course, the paperboard material provides certain of the structural strength depending on the grade of paper used in its formation. Heavier paper grades provide greater strength in stacking and bursting. The structure of the container can add greatly to its strength properties.

Typically a packed container of produce will hold a weight suitable for handling by an individual. Such containers will be generally rectangular and have a variable height dimension ranging from three to twelve inches. Further, these containers will normally be stacked for transport and storage.

Given the basic size requirement specified by the customer it is then an effort to provide the structural stacking strength with the optimum amount of corrugated paperboard. A typical well known single piece container design is one having a bottom, two side walls hinged to the bottom and at least two end walls hinged to the bottom. To form the container the walls are folded upwardly to be normal to the bottom and then connected to form the containment volume within the four walls. Variations are well known where top closure flaps are hinged to the top edges of the side walls and for stacking strength a second end wall can be hinged to the top edge of first end wall to then form a double layer of paperboard thereby enhancing the stacking strength. Additional known features used in such containers include, for example, additional panels hinged to the end wall side edges which are used to form vertical inclined corner posts and additional layers along the side walls to likewise enhance stacking strength. When even greater stacking strength is required, additional foldable panels can be added to yield three or four ply end wall variations. When providing such containers, it is an objective to provide the maximum stacking strength utilizing the least amount of material while at the same time providing all of the other features specified by the customer, such as stacking tabs, hand holds, vent holes and the like.

One objective of the present invention is to provide a single piece container blank which utilizes reduced material with the same or enhanced stacking strength.

Another objective is to provide a container with multiply end walls utilizing less material which has the same or enhanced strength.

Yet another objective is to provide a trapped stack tab as a part of the multiply end wall construction with sufficient structure to resist "fold over" during use.

These and other objects of the invention will become apparent upon reading the specification to follow in combination with the attached drawings.

SUMMARY OF THE INVENTION

Briefly stated, the present invention is practiced by cutting and scoring from a single blank of paperboard an erectable multiply tray type container. Each end wall has a four ply construction and includes a pair of opposed two ply stacking tabs. For greater strength a corner post construction is provided along with a reinforcing panel extending down a side wall. Top closure panels are provided with openings therein at each end for engaging the stacking tabs in a locking arrangement.

BRIEF DESCRIPTION OF THE DRAWINGS

FIG. 1 is an isometric view showing the erected container with its closure flaps locked.

FIG. 3 is an isometric view showing the container as it is being formed.

FIG. 4 is a view similar to FIG. 3 showing the container where one end panel has been erected.

FIG. 5 is also a view similar to FIG. 3 but showing both end panels after being formed and with the closure flaps open for receiving product.

DETAILED DESCRIPTION OF THE PREFERRED EMBODIMENT

Figure 2:
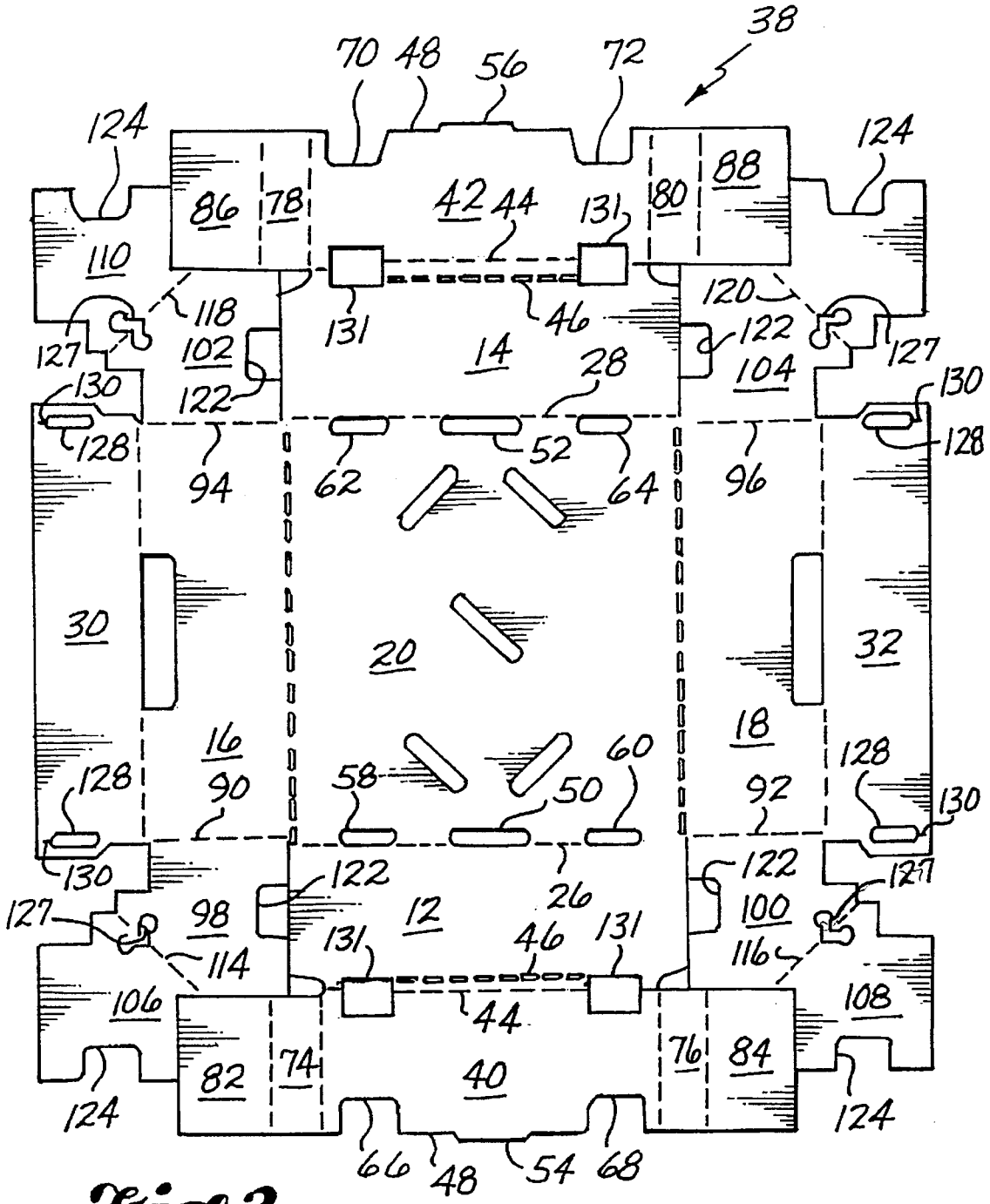
FIG. 2 is a top plan view of the single piece blank after having been cut and scored but prior to being erected into a formed container.

Referring first to FIG. 1 a tray type container is illustrated generally at 10. It is a typical container in that it has a pair of upstanding outer end walls 12, 14, a pair of upstanding relatively longer side walls 16, 18, and a bottom wall 20. Side walls 16, 18 are hingedly connected to bottom wall 20 through score lines 22, 24 while end walls 12, 14 are likewise hingedly connected to bottom wall 20 through score lines 26, 28 (see FIG. 2). Extending outwardly from the top edges of side walls 16, 18 are opposed closure flaps 30, 32 each hingedly connected through score lines 34, 36. A typical alternative to the embodiment of FIG. 1 provides a separate closure member to cover an open top. While the type of produce placed within the container is not a part of the invention, the presently disclosed embodiment is particularly useful for packaging fresh fruits and vegetables. Also, the embodiment depicted is for manual setup in the field when ready for use. This is opposed to machine setup where automated equipment will fold and join container parts (usually with adhesives) into a permanent box form. Here, as will become more apparent upon following the description of FIG. 2, the parts of the container are folded and interconnected manually utilizing typical folds, tucks and mechanical joints. Once formed into the open container fresh fruits, produce, or any other product can be placed within the walls of container 10.

Turning now to FIG. 2 the flat blank for container 10 is generally indicated at 38. Typically, although not essential for the present invention the blank material is corrugated paperboard where a corrugated medium layer has liner sheets bonded thereto forming the three layer flat paperboard blank. In order to provide the stacking strength the corrugations run from top to bottom as will be well understood by those with ordinary skill in the art. As previously described, bottom wall 20 has four panels hingedly connected to its four straight side edges to form the walls of the erected container.

Hingedly connected to outer end walls 12, 14 are the opposed inner end walls 40, 42. The respective hinge lines 44, 46 are provided so a two ply layer of the paperboard material will be accommodated between the inner and outer end walls when they are folded up to lay adjacent one another, i.e., hinge lines 44, 46 are double wide score lines to accommodate the two ply thickness. The height dimension of each inner end wall is established so its outer edge portions 48 will be against the corresponding portion of the surface of bottom 20 thereby creating a standard double ply end panel. Located centrally and opposed laterally within bottom 20 are slots 50, 52. A cooperating locking tab 54, 56 respectively, depends outwardly from the outer edge 48 of each inner end wall 40, 42.

As pointed out, stacking tabs are commonly provided and normally the tabs will extend into receptacles in a container stacked in-line above the one below. Pairs of spaced slots 58, 60 and 62, 64 are located in the bottom wall along score lines 26, 28. Each slot is sized to accept a tab extending into the slot. Provided along the outer edge of the inner end walls 40, 42 are pairs of opposed rectangular cutouts 66, 68 and 70, 72 likewise sized to accept a stacking tab when like containers are stacked one atop another.

At each end of inner end walls 40, 42 are two additional panels hingedly connected thereto and having the same width. Panels 74, 76, 78, 80 will form vertically extending inclined comer posts to enhance stacking strength and panels 82, 84, 86, 88 will extend down the inner surface of its adjacent side wall. It is to be seen in FIG. 2 that the lateral dimension for inner end walls is less than the outer end walls to provide the inclined corner posts.

At each end of a side wall panel are additional panels hingedly connected thereto along respective score lines 90, 92, 94, 96. Each panel is comprised of two portions, an inner portion 98, 100, 102, 104, respectively, and an outer portion 106, 108, 110, 112, respectively. The cooperating portions are connected along an inclined score line 114, 116, 118, 120, respectively. Inner portions are sized so they can form another vertical reinforcing layer within the multiply end panels, with each portion spanning slightly less than the container width and having a height dimension slightly less than the height dimension of a corresponding outer end wall panel. The outer portions are similarly sized and when folded 180° about their inclined score line form an additional double ply reinforcing panel to form part of the composite end wall construction. The double ply panel will have cutouts formed therein by cooperating rectangular cutouts, each indicated at 122 and 124 in order to accommodate a stacking tab protruding upwardly through slots 58, 60 and 62, 64 in bottom wall 20.

Provided in the respective pairs of inner and outer portions of the additional panels will be a two ply trapezoidally shaped stacking tab each indicated in FIG. 1 at 126. Stacking tabs 126 are formed when the inner and outer portions are folded 180° to form the added two ply reinforcing panel. Intersecting each inclined score line is a cutout portion 127 that serves to create a locking hook 129 when in the formed container. Hooks 129 face inwardly and will act to lock the top closure flaps in place. Tabs 126 will extend upwardly through cutouts 131 located along double score lines 44, 46.

In forming the container from flat blank 38 (refer to FIGS. 3–5) the side walls can first be folded upwardly 90° and then the additional reinforcing panels formed by folding 180°. Thereafter, the double ply panel is turned inwardly 90° along the end wall hinge lines. The outer end walls are then folded up 90° to abut the two-ply reinforcing panels. Thereafter the inner end panel will have its two outer panels folded to form the inclined corner post and reinforcing panel along the side wall. Finally, the inner end wall is locked in place by forcing the locking tabs into the corresponding slots in the bottom wall.

Once the container is formed, product can be loaded and after filling the top closure flaps folded over. Within each end of a closure flap are slots, each indicated at 128 and a short slit, each indicated at 130, at the outer end of its slot. The slots are engaged over the upwardly extending stacking tops and the slits provide a positive locking engagement with the hooks in the respective tab.

Variations to the preferred embodiment as just described may occur to those skilled in the art. The appended claims are intended to include all such apparent and obvious modifications.

I claim:

1. In a paperboard container of the type formed from a single blank cut and scored and having a bottom wall, sidewalls extending upwardly from the bottom wall, and two multiply end panels, the improvement comprising:

at least one of the multiply end panels comprising an end wall hinged to the bottom wall and at least one additional panel comprised of an inner portion hinged to the end of the adjacent sidewall and an outer portion hinged to the inner portion along an inclined hinge line, whereby the inner and outer portions when folded 180° form a two-ply panel traversing less than one-half of the container width, and a stacking tab extending upwardly from the top edge of the at least one multiply end panel and formed by cutout edges of the inner and outer portions of the additional panel.

* * * * *

UNITED STATES PATENT AND TRADEMARK OFFICE

CERTIFICATE OF CORRECTION

PATENT NO. : 5,649,663

DATED : July 22, 1997

INVENTOR(S) : Charles A. Pestow, Jr.

It is certified that error appears in the above-identified patent and that said Letters Patent is hereby corrected as shown below:

ON THE TITLE PAGE

[57] In the Abstract, line 1:

"signle" should read --single--

"peece" should read --piece--

Please add in the third line after "four ply" --construction formed by panels extending from the ends of the side walls to form two of--

Signed and Sealed this

Twentieth Day of January, 1998

*Attest:*

*Attesting Officer*

BRUCE LEHMAN

*Commissioner of Patents and Trademarks*